US010495085B2

(12) United States Patent
Hayes-Pankhurst et al.

(10) Patent No.: US 10,495,085 B2
(45) Date of Patent: Dec. 3, 2019

(54) PUMP ARRANGEMENTS FOR PUMPING FLUID

(71) Applicant: QUANTEX PATENTS LIMITED, London (GB)

(72) Inventors: Richard Paul Hayes-Pankhurst, London (GB); Jonathan Edward Ford, Cambridge (GB)

(73) Assignee: QUANTEX PATENTS LIMITED, London (GB)

( * ) Notice: Subject to any disclaimer, the term of this patent is extended or adjusted under 35 U.S.C. 154(b) by 130 days.

(21) Appl. No.: 15/558,897

(22) PCT Filed: Mar. 17, 2016

(86) PCT No.: PCT/EP2016/055856

§ 371 (c)(1),
(2) Date: Sep. 15, 2017

(87) PCT Pub. No.: WO2016/146771

PCT Pub. Date: Sep. 22, 2016

(65) Prior Publication Data

US 2018/0073503 A1 Mar. 15, 2018

(30) Foreign Application Priority Data

Mar. 18, 2015 (GB) ..... 1504553.7

(51) Int. Cl.
*F04C 15/00* (2006.01)
*F01C 5/04* (2006.01)
(Continued)

(52) U.S. Cl.
CPC ..... *F04C 15/0015* (2013.01); *F01C 5/04* (2013.01); *F04C 5/00* (2013.01); *F04C 15/06* (2013.01);
(Continued)

(58) Field of Classification Search
CPC ..... F01C 5/04; F04C 15/0015; F04C 15/06; F04C 2240/20; F04C 2240/30; F04C 5/00
(Continued)

(56) References Cited

U.S. PATENT DOCUMENTS

2014/0255164 A1 9/2014 Hayes-Pankhurst et al.
2014/0348684 A1* 11/2014 Hayes-Pankhurst ..... F01C 5/04 418/129

FOREIGN PATENT DOCUMENTS

EM 2422048 2/2012
WO 2013050491 A1 4/2013

OTHER PUBLICATIONS

International Search Report and Written Opinion dated Jun. 3, 2016 in related PCT Application No. PCT/EP2016/055856 (pages).

* cited by examiner

*Primary Examiner* — Mark A Laurenzi
*Assistant Examiner* — Paul W Thiede
(74) *Attorney, Agent, or Firm* — Maschoff Brennan

(57) ABSTRACT

A pump comprising a housing and a rotor rotatably accommodated in the housing and having an axis of rotation. The housing comprises a resilient seal member, an inlet and an outlet for fluid. The rotor comprises first and second surface areas, and the rotor and housing are cooperatively configured such that the second surface area is radially recessed from the first surface area, forming a chamber with an interior surface of the housing, and the first surface area seals against the interior surface. The seal member is located azimuthally between the outlet and the inlet. The seal member will engage the first and second surface areas, operative to prevent the passage of fluid from the outlet to the inlet as the rotor rotates. An edge of the seal member is coterminous with an aperture through which the fluid can flow.

16 Claims, 4 Drawing Sheets

(51) Int. Cl.
*F04C 5/00* (2006.01)
*F04C 15/06* (2006.01)

(52) U.S. Cl.
CPC ..... *F04C 2240/20* (2013.01); *F04C 2240/30* (2013.01)

(58) Field of Classification Search
USPC ..... 418/129, 125
See application file for complete search history.

PUMP ARRANGEMENTS FOR PUMPING FLUID

FIELD OF THE INVENTION

This disclosure relates generally to pumps.

BACKGROUND

European patent application publication number 2 422 048 discloses a pump comprising a housing, the housing having an interior defining a rotor path, an inlet formed in the housing at a first position on the rotor path, an outlet formed in the housing at a second position on the rotor path spaced from the first position, and a rotor rotatable in the housing. At least one first surface is formed on the rotor and seals against the rotor path of the housing, and at least one second surface is formed on the rotor circumferentially spaced from the first surface and forming a chamber with the rotor path that travels around the rotor path on rotation of the rotor to convey fluid around the housing from the inlet to the outlet. A resilient seal is located on the rotor path and so extends between the outlet and the inlet in the direction of rotation of the rotor such that the first rotor surface seals with, and resiliency deforms, the seal, as the rotor rotates around the rotor path within the housing to prevent fluid flow from said outlet to said inlet past the seal.

SUMMARY

There is a need for a pump, particularly but not exclusively a relatively high pressure pump, exhibiting increased flow rate (for a given size of pump). There is also a need for a pump that purges all air during a priming regime. There is a further need for a pump allowing greater design freedom for the relative directions of the inlet and outlet.

Viewed from a first aspect, there is provided a pump comprising a housing and a rotor rotatably accommodated in the housing and having a longitudinal axis of rotation in use; the housing comprising a resilient seal member, an inlet and an outlet for fluid; the rotor comprising first and second surface areas; the rotor and housing cooperatively configured such that the second surface area is radially recessed from the first surface area, forming a chamber with an interior surface area of the housing, the first surface area seals against the interior surface of the housing, operative to contain the fluid within the chamber as the rotor rotates in use; the seal member is located azimuthally between the outlet and the inlet; in use, the rotor will rotate about the longitudinal axis and the chamber will be capable of receiving fluid from the inlet, conveying the fluid from the inlet to the outlet, and expelling the fluid into the outlet; the seal member will engage the first and second surface areas, operative to prevent the passage of fluid from the outlet to the inlet as the rotor rotates; in which an edge of the seal member is coterminous with (at least partly defines) an aperture through which the fluid can flow.

The first surface area of the rotor may be said to contact a rotor path defined by the interior of the housing with sufficient contact pressure to seal against the rotor path. This contact pressure will establish an upper limit of the pressure of the fluid capable of being pumped in use (the pressure capability of the pump).

In use, the seal member will remain in contact with the rotor throughout an entire revolution of the rotor, and will deform resiliently operative to remain in contact with the second surface area as it rotates past the seal member. The seal member may be urged against the rotor by a resilient biasing mechanism such as a resilient elastomer member or a spring. The cooperative action and configuration of the rotor and the seal member in use will substantially prevent the passage of fluid from the outlet to the inlet in use (and may prevent the outlet and inlet from coming into fluid communication in use). The resiliently biased seal member will have sufficient resilience and flexibility to deform in response to the rotation of the rotor, maintaining a sealing engagement with the rotor.

Various pump arrangements are envisaged by this disclosure, non-limiting and non-exhaustive examples of which are described below.

In some example arrangements, the chamber-forming surface of the rotor may be configured such that it exhibits a concave cross-section in all planes including the axis of rotation, and a convex cross-section in all planes perpendicular to the axis of rotation. In some example arrangements, the second surface area may be concave when viewed in longitudinal and/or radial cross-section, and may be entirely surrounded by the first surface area; and in some examples it may be convex (provided that it will be radially spaced apart from the interior surface of the housing and radially recessed from the first surface area). The rotor may comprise a generally cylindrical or conical portion, located within the interior of the housing in use.

In some example arrangements, the rotor may comprise a plurality of second surface areas (i.e. the second surface area and additional surface areas), and consequently a plurality of chambers may be formed between each second surface area and the interior surface of the housing. In some examples, the rotor may comprise opposite ends connected by a side, which may consist of the first surface area and one or more second surface area.

The rotor may comprise a plurality of second surface areas spaced radially and axially. In some example arrangements, the housing may be configured such that the fluid will be expelled from the chamber through the aperture to the outlet, in use. In other words, the aperture may direct the fluid towards the outlet. In other example arrangements, the housing may be configured such that fluid will flow from the inlet and then through the aperture and into the interior of the housing (and into a chamber). For example, the pump may be configured such that the inlet passes into a cavity that will be partially separated by the seal member (apart from the aperture) from the chamber.

The outlet may be in fluid communication with an underside of the seal member, opposite the side surface of the seal member that will engage the rotor in use, and in fluid communication with the aperture. The pressure of fluid in the outlet will be transmitted to the under-surface of the seal member, thus urging the seal member against the rotor in use.

In some example arrangements, the outlet and inlet may be oriented in substantially different directions relative to each other, and in some examples, the outlet may be oriented substantially perpendicular to the direction of the inlet, operative to the pump receiving fluid flowing in one direction through the inlet and expelling fluid through the outlet in a substantially different direction.

In some examples, the edge of the seal member may comprise a tear-resisting means or configuration, such as a thickened or beaded portion, operative to strengthen the edge.

In some example arrangements, the seal member may comprise or consist of a flexible diaphragm, wall or foil, which may comprise or consist of the same material as the housing. In some examples, the seal member may comprise or consist of material having relatively high elastic modulus, such as injection moulded polypropylene, and may have a mean thickness of 0.1 to 0.3 mm. In some examples, the seal member may comprise or consist of material having relatively low elastic modulus, such as rubber, and may have mean thickness of at least 0.1 mm or 0.5 mm and/or at most 1 mm. In some examples, the seal member may be integral with the rest of the housing; the seal member may be formed in one piece with the rest of the housing, the seal member and the rest of the housing comprising the same material. The seal member may comprise or consist of elastomer material, such as plastics material.

In some example arrangements, the entire aperture may be defined by (coterminous with) the edge of the seal member. In some examples, the edge of the seal member may be spaced apart from the housing, or another portion of the housing. In some examples the aperture may be defined by the edge of the seal member and the housing, or another portion of the housing if the seal member is formed in one piece as part of the housing.

In some example arrangements, the seal member may comprise an under-surface opposite a surface of the seal member engaged by the rotor, and the housing may be configured such that the under-surface will be in fluid communication with the aperture, in use. In some examples, the housing and pump may be configured such that a second fluid, at higher pressure than the first fluid entering the pump via the inlet in use, can flow from a source to contact the under-surface, operative to urge the seal member against the rotor.

In some example arrangements, the pump may comprise a resilient biasing member configured operative to urge the seal member against the rotor. For example, the resilient biasing member may comprise elastomeric material, and may be in the general form of a tube, pad or elongate U-shaped member.

The presence of the aperture may have the aspect of increasing the maximum operating pressure of example pumps to at least about 6 bar. As the pressure applied to the seal member will vary automatically with output pressure, a single example pump arrangement may be used for a variety of applications requiring a wide range of pressures. In addition, the pump may always operate with a lower (potentially minimum) torque, since the risk of the force between the seal member and the rotor being unnecessarily high may be substantially reduced.

In some example pumps, the housing may comprise a wall surrounding the seal member on the side of the seal member opposite the rotor, providing a cavity that can be at least partly closed by a cap, which may include an outlet (such a wall and cavity may be referred to as a 'turret').

In example arrangements, the edge of the seal member that is coterminous with (or that defines at least a part of) the aperture may be described as unattached, or free; in use, fluid may flow through the aperture and in direct contact with the edge. The aperture may be described as passing through the seal member, the unattached edge connecting opposite sides or boundaries of the seal member; the aperture may put opposite surfaces of the seal member in fluid communication with each other, and with the unattached edge.

In some example arrangements, the seal member may have substantially uniform thickness, or it may have a non-uniform thickness; it may have a uniform or a mean thickness of at least about 0.1 mm; and/or at most about 3.0 mm or at most about 1.0 mm. In some example arrangements, the seal member may comprise or consist of a diaphragm, which may be formed as a diaphragm portion of the housing.

In some example arrangements, the seal member may consist of or comprises a diaphragm having a rotor-facing surface which will be engaged by the rotor in use, and an under-surface opposite the rotor-facing surface; in which the unattached edge connects the rotor-facing surface and the under-surface. In some examples, at least an area of the under-surface adjacent the unattached edge may be exposed to the fluid in use, or the under-surface adjacent the unattached edge may be contacted by a resilient biasing member. At least an area of the under-surface may be in fluid communication with the aperture.

In some example arrangements, the aperture may be substantially circular or square, or have some other arcuate and/or polygonal shape. For example, the aperture may be a substantially rectangular slot defined by the edge of the seal member and the housing, or another portion of the housing.

In some example arrangements, the unattached edge may extend longitudinally and connect longitudinally opposite ends of the seal member. In some examples, the aperture may extend azimuthally over an aperture width, and the seal member may extend azimuthally over a seal width. In some examples, the aperture width may be less than or approximately equal to the seal width. For example, the aperture width may be up to about half the seal width.

In some example arrangements, the seal member may be configured such that at least a section of the unattached edge can travel through a greater radial distance than any other part of the seal member, in response to the seal member being flexed as the rotor rotates through a full revolution as in use. In some examples, at least a section of the unattached edge may travel the radial distance from the outermost (largest) radius of the first surface area to the innermost (smallest) radius of the second surface area of the rotor, as the rotor rotates as in use.

In some example arrangements, the seal member may comprise a plurality of apertures coterminous with a respective plurality of unattached edges.

In some example arrangements, the pump may comprise a resilient biasing member configured to urge the seal member against the surface of the rotor as the rotor rotates in use; the seal member may be variably flexed by the resilient biasing member in response to the rotation of the rotor, operative to expel fluid from the chamber (which is partly formed by the second surface area of the rotor), as the second surface area rotates against the seal member in use. In some example arrangements, the aperture may put the resilient biasing member in fluid communication with the unattached edge of the seal member, and with the rotor.

In some examples, at least a section of the unattached edge may be flexed to conform to the shape of the rotor surface, and may remain adjacent the surface of the rotor as it rotates through a full revolution; in some examples, the resilient biasing member may flex the entire length of the unattached edge against the first and second surface areas of the rotor as the rotor rotates past the edge in use.

Viewed from a second aspect, there is provided a housing for an example disclosed pump. In some example arrangements, the housing may comprise a resilient seal member, an inlet for fluid and an outlet for the fluid; in which the seal member may comprise or consist of a diaphragm having a rotor-facing surface, which will be engaged by the rotor in use; an under-surface opposite the rotor-facing surface; and an unattached edge that is coterminous with an aperture through which the fluid can flow in use; in which the unattached edge connects the rotor-facing surface and the under-surface.

Viewed from a third aspect, there is provided an assembly of parts for an example disclosed pump. In some examples, the assembly of parts may be partial of complete, and may comprise at least a housing for the pump and a rotor for the pump. In some examples, the assembly of parts may comprise a resilient biasing member for urging the seal member against the surface of the rotor as the rotor rotates within the housing as in use.

Example disclosed pumps may have the aspect of allowing the seal member to exhibit greater flexibility in use, which may arise from an edge of the seal member being unattached and thus capable of greater displacement in use. Example pumps may have the aspect of being easier to purge of air prior to use, since air within the pump can be induced to pass through the aperture and out of the outlet. This may be particularly useful in applications in which the fluid, particularly liquid, being pumped will be at relatively high pressure and may flow into the pump though a turret. It may be particularly important in medical applications, in which the presence of air in the pump may pose a risk to a person being treated (for example, where the pump is used to pump fluid intravenously into a patient). The presence of the aperture as disclosed will make it easier to configure an example pump such that the inlet and outlet are at substantially different orientations to each other; perpendicular to each other, for example.

BRIEF DESCRIPTION OF THE DRAWINGS

Example pump arrangements will be described with reference to the accompanying drawings, of which

DETAILED DESCRIPTION

Figure 1A:
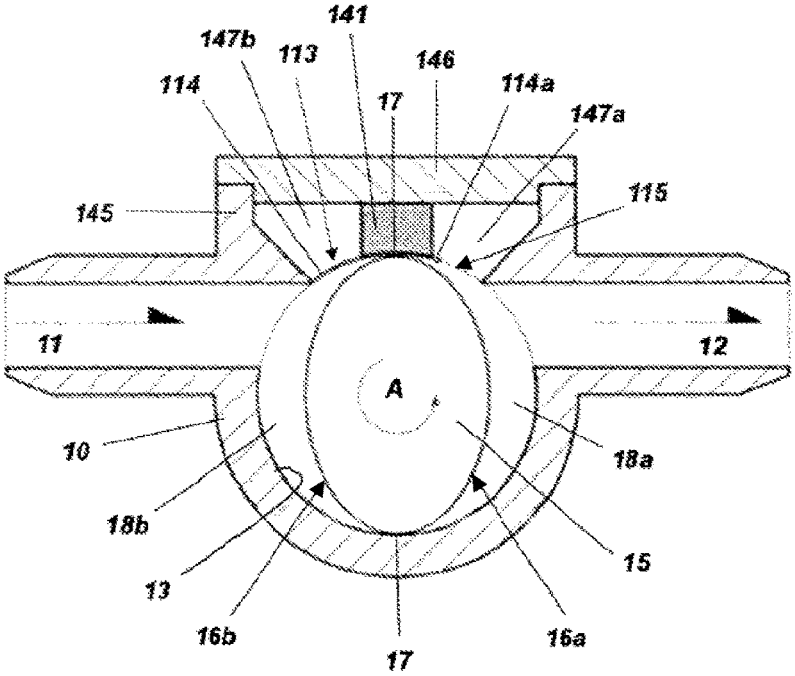
FIG. 1A shows a schematic side cross-section view through an example pump arrangement, the view being perpendicular to a longitudinal axis of rotation of the rotor in use.
Figure 1B:
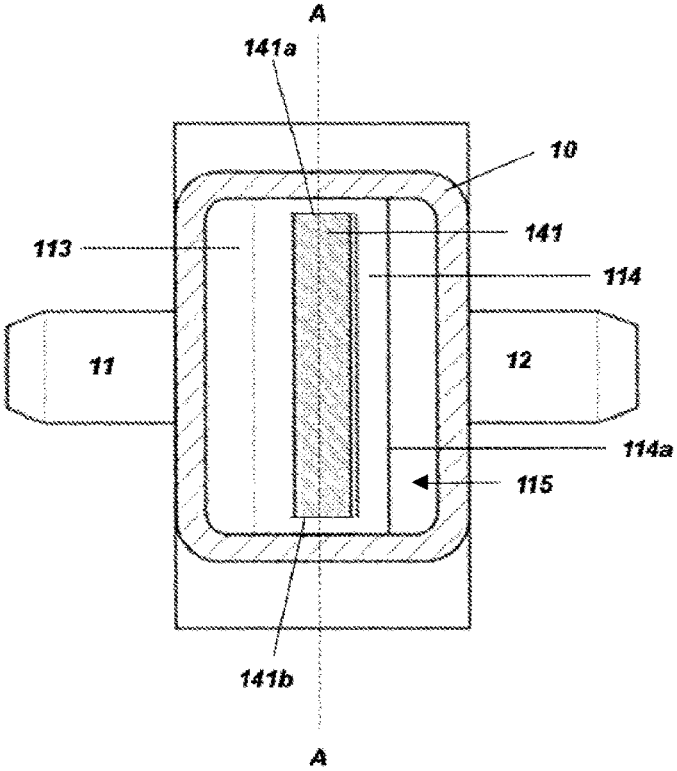
FIG. 1B shows a schematic plan cross-section view through an example pump arrangement, the view being parallel to the longitudinal axis A.
Figure 2:
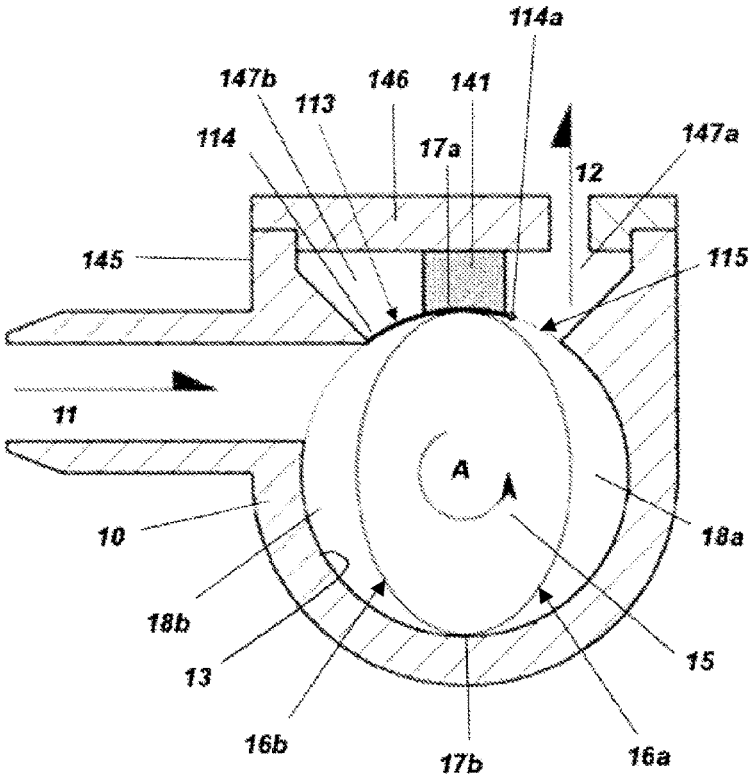
FIG. 2 shows a schematic side cross-section view through an example pump arrangement, the view being perpendicular to a longitudinal axis of rotation of the rotor in use.

With reference to FIG. 1A, FIG. 1B and FIG. 2, example pump arrangements comprise a housing 10, a rotor 15 rotatably accommodated in the housing 10 and having a longitudinal axis A of rotation in use. The housing 10 comprises an inlet 11 and an outlet 12 for fluid, and a seal member 114. The seal member 114 may comprise a flexible diaphragm (such a seam member may simply be referred to as a 'diaphragm') comprising or consisting of resilient material, and may be formed as an integral portion of the housing 10, comprising or consisting of the same material as the rest of the housing 10, in some examples. The rotor 15 may comprise a first surface area 17 and a pair of mutually opposite, convex second surface areas 16 *a*, 16 *b* that are radially recessed from the first surface. The rotor 15 may be elongate, extending along its longitudinal axis of rotation A in use, comprising opposite ends connected by a side surface, which may comprise or consist of the first and second surface areas 17, 16 *a*, 16 *b*. Each of the second surface areas 16 *a*, 16 *b* will remain radially spaced apart from the interior surface 13 of the housing 10, each forming corresponding chambers 18 *a*, 18 *b* between itself 16 *a*, 16 *b* and the interior surface 13. In the field of medicine, in which example pumps may be used to supply medication intravenously to a patient, each of the chambers 18 *a*, 18 *b* may be referred to as a 'bolus'. The rotor 15, housing 10 and seal member 114 are cooperatively configured such that the first surface area 17 seals against an interior surface 13 of the housing 10 as the rotor 15 rotates in use. In example arrangements, the first surface area 17 may completely surround each of the second surface areas 16 *a*, 16 *b*. In other words, second surfaces may not be present adjacent the opposite ends of the rotor 15, where the first surface area 17 may extend azimuthally all the way around the side of rotor 15, sealing against the interior surface 13 of the housing 10 to prevent fluid from flowing between the chambers 18 *a*, 18 *b* at the ends of the rotor 15. In the examples illustrated in FIG. 1A, FIG. 1B and FIG. 2, the housing 10 and rotor 15 are configured such that the chambers 18 *a*, 18 *b* will never be in simultaneous fluid communication with each other nor with both the inlet 11 and the outlet 12 in use. The seal member 114 is located between the outlet 12 and the inlet 11 and will engage the first surface area 17 continuously and each of the second surface areas 16 *a*, 16 *b* periodically and sequentially in use (adjacent the opposite ends of the rotor 15, the seal member 114 may continuously engage the first surface 17 as the rotor 15 rotates in use). The passage of fluid from the outlet 12 to the inlet 11 will thus be prevented as the rotor 15 rotates in use.

In the particular example arrangements shown in FIG. 1A, FIG. 1B and FIG. 2, an edge 114*a* of the seal member 114 forms an aperture 115 through which the fluid will flow from each of the chambers 18*a*, 18*b* into a cavity 147*a*, 147*b*, the latter volume of the cavity being coterminous with an under-surface 113 of the seal member 114. The edge 114*a* of the seal member 114 may be thicker than the rest of the seal member 114 in order to provide the edge with sufficient strength not to tear or propagate a tear in use. The cavity 147*a*, 147*b* may be partly formed by a turret portion 145 of the housing 10 and a fluid-tight turret cap 146.

A resilient displacer pad 141, which may be provided by a longitudinally elongate elastomeric displacement pad, in contact with or attached to the turret cap 146 may engage at least part of the seal member 114 and resiliently urge the seal member 114 against the surface areas 17, 16 *a*, 16 *b* of the rotor 15 in use, deforming by radial compression and extension as the seal member 114 engages the first 17 and second surfaces 16 *a*, 16 *b*, to prevent fluid from flowing from the outlet 12 to the inlet 11 in use. In the example illustrated, the resilient displacer pad 141 will bear against the under-surface of the seal member 114 to urge the seal member 114 against the surface of the turret cap 146 in use. Opposite ends 141 *a*, 141 *b* of the resilient displacer pad 141 may be sufficiently spaced apart from the housing 10 such that the volumes 147 *a*, 147 *b* of the cavity are in fluid communication with each other. The fluid contacting the under-surface 113 may urge the seal member 114 against the surface of the rotor 15 in use if the pressure of the fluid in the outlet 12 (and chamber 18 *a*) is greater than that in the inlet 11, or may counter-balance the force on the seal member 114 applied by the fluid in the inlet (and chamber 18 *b*).

Example pumps comprising a resilient displacer pad 141 as described above may have the aspect of allowing the pump to be used at higher pressures, since additional pressure from the resilient displacer pad 141 will tend to resist the forced passage of fluid between the rotor 15 and the seal member 114. The force applied by the resilient displacer pad 141 may be chosen to allow the pump to operate at a lower end of a range of operating pressures for which the pump is designed, for example up to 0.5 bar where the inlet and outlet pressures are at or close to ambient pressure. The force applied by the seal member 114 to the rotor 15 will be the sum of the force applied by the resilient displacer pad 141 and the force applied by the fluid. The applied force may depend to some extent on the outlet pressure, an increase in outlet pressure resulting in a corresponding increase in the force applied to the seal member 114, thus reducing the risk of leakage between the seal member 114 and the rotor 15 as a result of the increased pressure.

When the rotor 15 is oriented within the housing 10 such that a chamber 18*a*, 18*b* is in fluid communication with the inlet 11, fluid will be received into the chamber 18*a*, 18*b*, and subsequently conveyed about the interior of the housing 10 as the rotor 15 and consequently the chamber 18*a*, 18*b* rotates in use, until the chamber 18*a*, 18*b* is in fluid communication with the outlet 12 and it is no longer in fluid communication with the inlet 11, owing to the sealing effect of the engagement of the first surface area 17 of the rotor 15 and the interior surface 13 of the housing 10, which prevents the chambers 18*a*, 18*b* from being in fluid communication with each other, in the particular examples illustrated. As the chambers 18*a* and 18*b* sequentially come into fluid communication with the inlet, a volume of relatively low pressure will arise within the chamber, into which the fluid will be forced to flow. In some examples, a pressure drop of up to about 0.75 bar may readily be achieved. This transient low pressure volume will also have the effect of 'sucking' the seal member 114 onto the rotor 15, thus further increasing the effective contact pressure. As the rotor 15 rotates further in use, fluid is expelled from the chamber 18*a*, 18*b* into the outlet 12. In the particular examples illustrated in FIG. 1A, FIG. 1B and FIG. 2, the chambers 18*a*, 18*b* are opposite each other and so when one of the chambers 18*a* is in fluid communication with the inlet 11, the other 18*b* will be in fluid communication with the outlet 12.

With reference to FIGS. 1A and 1B, the resilient displacer pad 141 may provide a fluid-tight bulkhead between the volumes 147 *a*, 147 *b* of the cavity such that the outlet pressure is regulated by the force applied to the seal member 114; then, if the pressure of the fluid in the outlet is higher than a desired value, the fluid will lift the seal member 114 off the rotor 15 against the force of the resilient displacer pad 141, the sealing pressure of which has been calibrated for sustaining an upper limit of outlet fluid pressure.

With particular reference to FIG. 2, the outlet 12 may be located downstream from the aperture 115 and the cavity 147 *a*, so that the fluid will flow from the chamber 18 *a*, through the aperture 115, through the cavity 147 *a*, past the resilient displacer pad 141 and then through the outlet 12. The pump may be configured such that fluid will be expelled through the outlet 12 substantially perpendicularly to the direction in which the fluid flows through the inlet 11.

Figure 3:
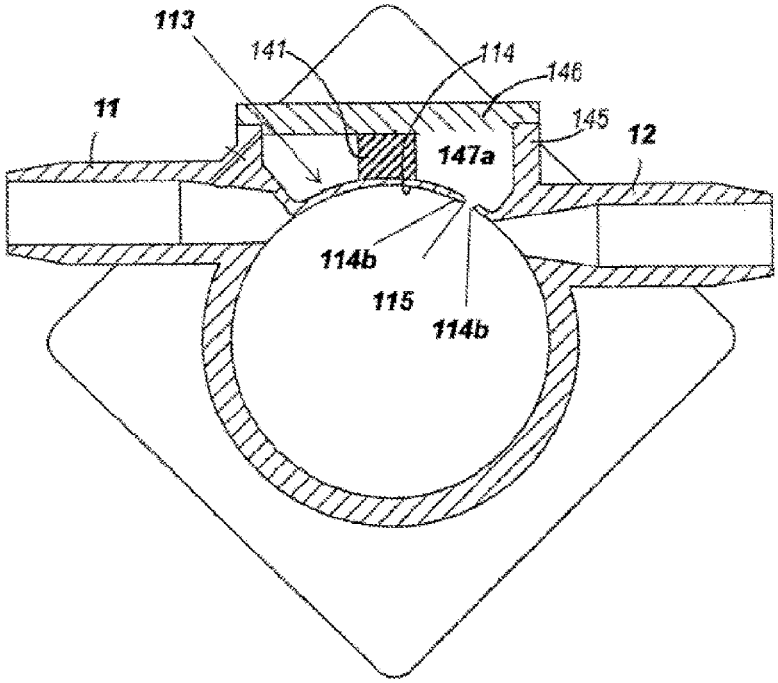
FIG. 3 shows a schematic side cross-section view through an example housing, the view being perpendicular to a longitudinal axis of rotation of the rotor in use (the rotor is not shown in this drawing)

With reference to FIG. 3, an example housing for an example pump arrangement may comprise a seal member 114, which may be a resilient seal member, formed as part of the housing, and includes an aperture 115 provided through the seal member 114, which may be a diaphragm, such the aperture is defined entirely by an continuous edge on the seal member 114 or internal edge 114 *a*, 114 *b* of the seal member 114.

Figure 4:
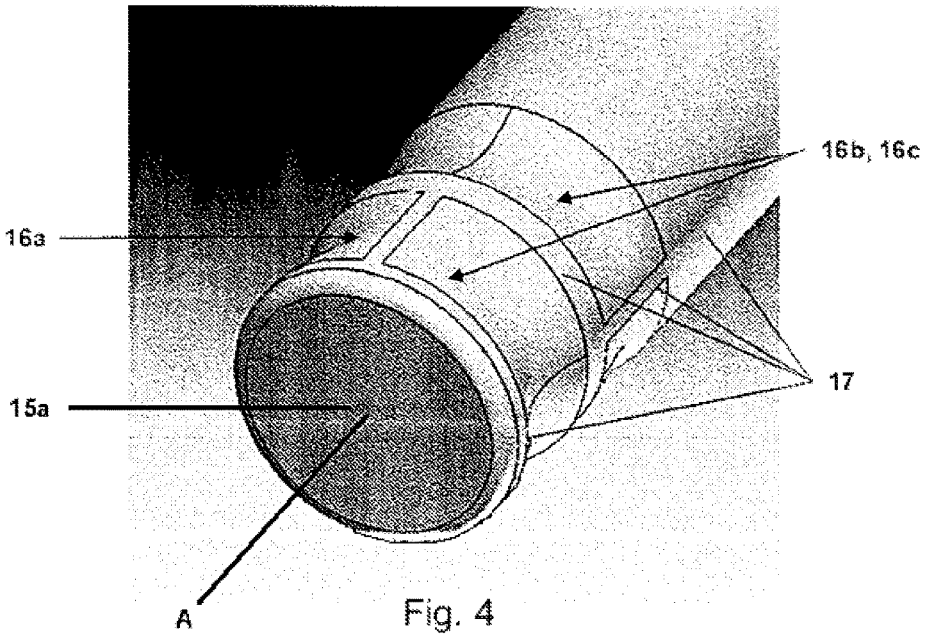
FIG. 4, FIG. 5 and FIG. 6 show schematic perspective views of example rotors.

With reference to FIG. 4, an example rotor may comprise a radially outer-most first surface area 17 completely surrounding a plurality of second surface areas 16 *a*, 16 *b*, 16 *c* (the second surfaces visible in FIG. 4), each of which may be described as a smooth recessed area of the rotor surface, extending azimuthally about, and axially along the longitudinal axis A of the rotor. A portion of the first surface area 17 adjacent an end 15 *a* of the rotor may extend azimuthally all the way around the rotor surface so that fluid will be prevented from flowing past the end 15 *a* of the rotor in use. The first surface 17 is continuous and surrounds each of the second surfaces so that fluid is prevented from flowing from one bolus to the next either axially or radially. Certain of the second surface areas 16 *b*, 16 *c* may be longitudinally separated from each other by a portion of the first surface area 17.

Figure 5:
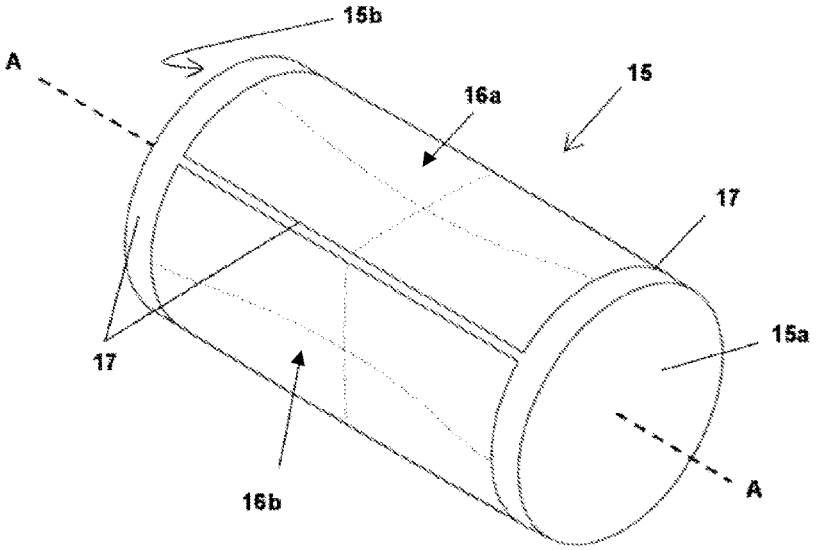
Figure 6:
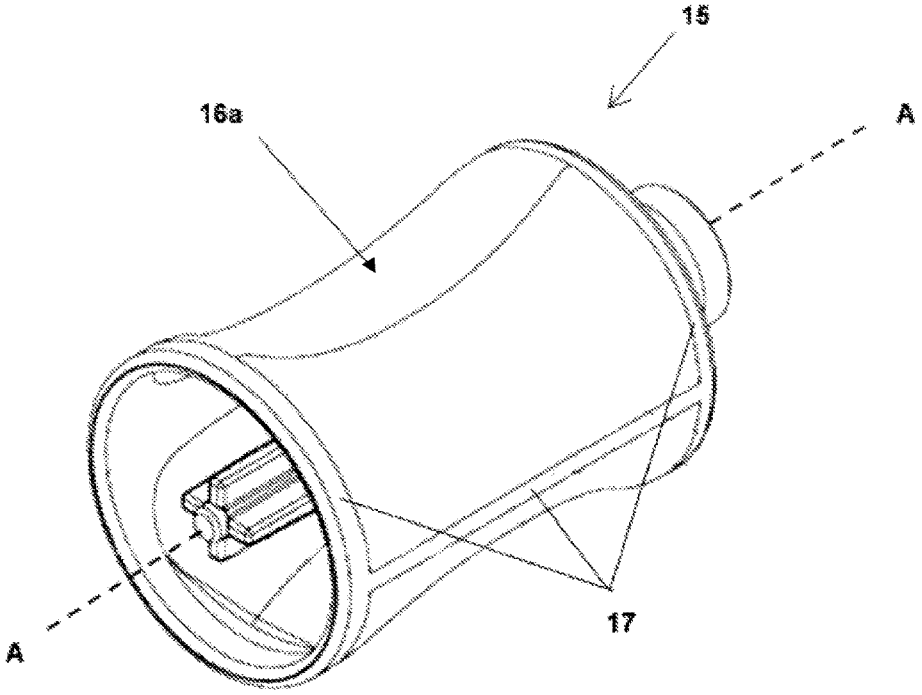

With reference to FIG. 5 and FIG. 6, example rotors 15 may comprise a radially outer-most first surface area 17 completely surrounding each of a plurality of second surface areas 16 *a*, 16 *b* (the second surfaces visible in FIG. 5), each of which may be described as a smooth, concave recessed area of the rotor surface, extending azimuthally about the longitudinal axis A of the rotor as well as longitudinally along the axis A, but not connecting the ends 15 *a*, 15 *b* of the rotor 15. A portion of the first surface area 17 adjacent each end 15 *a*, 15 *b* of the rotor 15 may extend azimuthally all the way around the surface of the rotor 15 so that fluid will be prevented from flowing past the ends 15 *a*, 15 *b* in use.

In some examples, the seal member and the rest of the housing may be formed from an elastomeric, such as a thermoplastic material by a process including a single shot injection moulding process. The seal member may be a diaphragm that extends circumferentially from the inlet to the outlet (apart from the aperture formed at least partly by an edge of the diaphragm). For example, the thickness of the diaphragm may be about 0.15 mm. The material comprised in the housing and the thickness of the seal member diaphragm will be chosen such that the diaphragm can distort sufficiently when contacted by the first and second surface areas of the rotor to remain in constant contact with these surface areas, examples of potentially suitable materials being polyethylene or polypropylene. The diaphragm will be substantially thinner than the housing (or the rest of the housing), such that the housing will contact the rotor resiliently with sufficient contact pressure as well as to support a seal member diaphragm that is sufficiently flexible to distend fully into contact with second surfaces of the rotor chambers. A polypropylene housing may have a general housing thickness of 1.5 mm carrying a diaphragm 0.15 mm thick. A lower modulus material such as rubber may have a general wall thickness of 5 mm carrying a diaphragm 0.5 mm thick.

In order for the seal member to be flexible enough to follow the contour of the surface areas of the rotor as it rotates, the seal member can be moulded with a very thin wall section. By careful processing using temperature and pressure feedback sensors and local venting to eliminate gassing it is possible to achieve seals with a wall thickness of about 0.1 to 0.3 mm. In an example process, a sliding portion of an injection moulding tool that will create the outer surface of the seal member may be controlled independently of the tool opening and closing. In some examples, molten plastic may be injected into the tool by an injection screw, the seal member wall thickness being approximately twice the desired thickness in order to allow for some of the molten material to flow across the seal member. In some examples, the sliding portion of the tool may be advanced at the desired time within the injection cycle to create the desired seal member wall thickness without knit lines and creating sufficient packing pressure at the same time. The use of a single shot moulding process may exhibit the aspects (separately or in combinations) of reducing the number of manufacturing processes, having a faster cycle time, requiring simpler mould tools and mould machinery and leading to higher manufacturing yield and lower production costs than a two-shot process. Pumps formed in a single-shot moulding process may have the aspect of having a longer operational life.

In some examples, the use of a suitable flexible material for the seal member and the rest of the housing may require the incorporation of stiffening members such as flanges on the housing to provide it with sufficient rigidity particularly to maintain the desired interface pressure with the rotor.

In example pumps, the interior of the housing and the exterior of the rotor may comprise complementary cylindrical surfaces. The operating torque and the maximum pumping pressure will likely be affected by the closeness of the fit between these parts and small manufacturing variations can have an adverse effect by increasing the required torque and by reducing the maximum pumping pressure through leakage.

Certain terms and concepts used herein will be briefly explained below.

In example arrangements in which a pump or part of a pump has a generally cylindrical (or conical) shape, thus having a degree of cylindrical symmetry, the use of terminology associated with a cylindrical coordinate system may be helpful for describing the spatial relationship between features. In particular, a 'cylindrical' or 'longitudinal' axis may be said to pass through the centres of each of a pair of opposite ends and the body or a part of it may have a degree of rotational symmetry about this axis. Planes perpendicular to the longitudinal axis may be referred to as 'lateral' or 'radial' planes and the distances of points on the lateral plane from the longitudinal axis may be referred to as 'radial distances', 'radial positions' or the like. Directions towards or away from the longitudinal axis on a lateral plane may be referred to as 'radial directions'. The term 'azimuthal' will refer to directions or positions on a lateral plane, circumferentially about the longitudinal axis.

What is claimed is:

1. A pump comprising:

a housing and a rotor rotatably accommodated in the housing and having a longitudinal axis of rotation;

the housing comprising:

a resilient seal member, an inlet and an outlet for fluid;

the rotor comprising first and second surface areas;

the rotor and housing cooperatively configured such that the second surface area is radially recessed from the first surface area, a second surface and an interior surface of the housing defining a chamber, the first surface area having a sealing engagement against the interior surface to contain the fluid within the chamber;

the seal member is located azimuthally between the outlet and the inlet; the seal member sized and shaped to engage the first and second surface areas as the rotor rotates about the longitudinal axis of rotation to prevent the passage of fluid from the outlet to the inlet;

wherein an unattached edge of the seal member defines an aperture with the housing.

2. The pump as claimed in claim 1, wherein the seal member comprises a diaphragm having a rotor-facing surface, and an under-surface opposite the rotor-facing surface; the unattached edge connecting the rotor-facing surface and the under-surface.

3. The pump as claimed in claim 1, wherein the aperture is substantially circular or square, or shaped as a substantially rectangular slot.

4. The pump as claimed in claim 1, wherein the unattached edge connects opposite ends of the seal member.

5. The pump as claimed in claim 1, wherein the aperture extends azimuthally over an aperture width, and the seal member extends azimuthally over a seal width, wherein the aperture width is less than the seal width.

6. The pump as claimed in claim 1, wherein the seal member is configured such that at least a section of the unattached edge can travel through a greater radial distance than any other part of the seal member in response to the seal member being flexed as the rotor rotates through a full revolution.

7. The pump as claimed in claim 1, wherein at least a section of the unattached edge travels the radial distance from the outermost radius of the first surface area to the innermost radius of the second surface area of the rotor as the rotor rotates.

8. The pump as claimed in claim 1, wherein the housing is configured such that the fluid is expelled from the chamber through the aperture to the outlet.

9. The pump as claimed in claim 1, wherein the seal member is formed in one piece with the housing, the seal member and the housing comprising the same material.

10. The pump as claimed in claim 1, wherein the entire aperture is defined by the edge of the seal member.

11. The pump as claimed in claim 1, wherein the seal member comprises elastomer material.

12. The pump as claimed in claim 1, wherein the seal member has a mean radial thickness of from 0.1 to 3.0 mm.

13. The pump as claimed in claim 1, wherein the seal member comprises an under-surface opposite a surface of the seal member contacted by the rotor, and the housing and pump are configured such that a second fluid contacts the under-surface to urge the seal member against the rotor.

14. The pump as claimed in claim 1, comprising a resilient biasing member configured to urge the seal member against the rotor, wherein the resilient biasing member comprises a fluid-tight bulkhead to prevent the outlet from being in fluid communication with the under-surface of the seal member, and is configured to force fluid in the outlet towards the inlet between the seal member and the rotor if the pressure of the fluid in the outlet exceeds a contact pressure maintained by the resilient biasing member.

15. The pump as claimed in claim 1, comprising a resilient biasing member configured to urge the seal member against the rotor; wherein the resilient biasing member and the seal member are configured such that the resilient biasing member variably flexes the seal member in response to the rotation of the rotor, and at least a section of the unattached edge remains adjacent the surface of the rotor as it rotates through a full revolution.

16. The pump as claimed in claim 1, wherein the seal member comprises:

a diaphragm having a rotor-facing surface configured to engage; and an under-surface opposite the rotor-facing surface;

wherein the unattached edge places the rotor-facing surface and the under-surface in fluid flow communication.

* * * * *